US005178590A

United States Patent [19]

Stephens

[11] Patent Number: 5,178,590

[45] Date of Patent: Jan. 12, 1993

[54] AERIAL EXERCISE ASSEMBLY

[75] Inventor: Peter M. Stephens, Friendswood, Tex.

[73] Assignee: Hershel M. Stephens, Chipley, Fla.

[21] Appl. No.: 784,778

[22] Filed: Oct. 30, 1991

[51] Int. Cl.[5] ..... A63B 7/02

[52] U.S. Cl. ..... 482/43; 482/23

[58] Field of Search ..... 482/23, 24, 43, 139; 434/247; 472/120, 124

[56] References Cited

U.S. PATENT DOCUMENTS

| | | | |
|---|---|---|---|
| 1,228,694 | 6/1917 | Netcott | 472/120 |
| 1,490,619 | 4/1924 | Manikowske et al. | 472/120 |
| 1,629,676 | 5/1927 | Buckminster | 482/24 |
| 2,123,233 | 7/1938 | Crawford | 482/24 |
| 3,379,439 | 4/1968 | Sorenson et al. | 482/43 |
| 3,937,461 | 2/1976 | Lew | 482/43 |
| 4,125,257 | 11/1978 | Lew | 482/43 |
| 4,340,216 | 7/1982 | Murphy | 482/43 |
| 4,431,184 | 2/1984 | Lew et al. | 482/24 |
| 4,449,716 | 5/1984 | Goldy et al. | 482/43 |
| 4,976,623 | 12/1990 | Owsley | 482/43 |

*Primary Examiner*—Richard J. Apley
*Assistant Examiner*—Lynne Reichard
*Attorney, Agent, or Firm*—James L. Jackson

[57] ABSTRACT

An aerial exercise assembly is provided which enables human users to achieve bounding, swinging and flipping exercise movements and comprises a set of swing members such as straps that extend downwardly from a support and which may be coupled to a single strap or rope for hoisting the user to a desired exercise position. A pair of elongate elastic members having multiple elastic strands establish elastic connection between the swing members and a pair of support straps. Extension of the elastic members is limited by safety cables to limit downward movement of the support straps to enhance the safety of the apparatus. Foot engaging elements, which may be loops or one or more foot boards, are provided at the lower ends of the support straps for stabilized engagement with the feet of the user. A pelvic harness is positionable about the pelvic region of the user and is provided with a pair of harness pivot straps that enable lateral positioning and 360° pivoting of the harness and the user relative to the support straps so that the user can accomplish flips while exercising and can accomplish bounding at both the upright and inverted positions. The harness pivot straps further enable the user to accomplish a substantially seated position such as for resting between periods of exercise.

24 Claims, 9 Drawing Sheets

AERIAL EXERCISE ASSEMBLY

FIELD OF THE INVENTION

This invention relates generally to aerial exercise devices and more particularly concerns an aerial exercise assembly enabling human users to achieve bounding, swinging, and flipping exercise movements and to achieve exercise positioning, including upright, inverted, substantially seated, etc.

BACKGROUND OF THE INVENTION

Trampolines have been used for gymnastics, including aerial aerobatics and have been useful for many years in the training of gymnasts especially from the standpoint of balance and body control. Trampolines are fairly large mechanisms which take considerable floor space in gymnastics facilities where floor space is typically at a premium. Some trampolines, however, include folding components that somewhat minimize the requirements for floor space when the trampoline is not being actively used. One of the more critical disadvantages of trampolines is the frequency of injuries that occur during use, especially when trampolines are being utilized by novices. Trampolines have generally rectangular frames within which is supported a fabric sheet by means of a plurality of springs that extend from the periphery of the sheet to the frame. Should a user become off-balance during trampoline exercise activity, it is possible to contact the frame or the space between the frame and sheet while descending, and it is also possible to miss the trampoline entirely, thus causing the user to impact with the floor of the facility. Falls onto and from trampolines have caused many serious injuries even though trampolines are considered quite useful from the standpoint of gymnastics training. It is desirable, therefore, to provide an aerial exercise mechanism that provides a user with the capability of achieving trampoline-like exercise activities while at the same time avoiding the inherent dangers of trampolines.

During gymnastics training on trampolines, those persons undergoing training are often fitted with a pelvic harness having a safety rope that is received by a pulley system and controlled by assistants. Should the user become off balance or improperly execute trampoline movements, the safety harness can be manipulated by by the assistant so as to prevent the user from falling improperly and perhaps becoming injured. It is desirable, therefore, to provide an exercise system enabling a user to achieve trampoline-like exercise activities in such manner that careful attention by an assistant is not required to prevent improper falling and injury to the user during exercise activity.

DESCRIPTION OF THE PRIOR ART

Apparatus for suspending an exercising individual for limited aerial aerobatics is well known in the art. U.S. Patents Nos. 4,052,070 and 4,125,257 disclose two such devices. Both devices rely on a mechanical advantage achieved by the use of a complicated system of pulleys and cables. These devices require the user to have considerable strength and athlet ic ability. Further, the complicated mechanical systems do not lend themselves to quick assembly and disassembly. More importantly, they provide no means for storing the energy expended by the individual user and subsequent release of that energy to enable bounding movement of the user. These devices are more suitable for gymnastics-type exercises such as are ordinarily achieved through the use of flying rings.

U.S. Pat. No. 3,519,239 discloses a simple device which incudes means for storing and reusing the energy of the user. This device is limited to use by small children and therefore can not be utilized for aerial aerobatics. A simple bounding or bouncing motion is all that may be achieved through use of this device.

Other aerial exercise devices that include pelvic harnesses are disclosed by U.S. Pat. Nos. 2,107,377; 3,432,163; and 4,431,184. These devices, for the most part, are of quite complex nature and they are fairly limiting as to the range of gymnastics or tumbling exercises that can be accomplished through their use. Exercise devices that function through the storage of energy applied by the human body and the release of that energy during exercise activities are set forth in U.S. Pat. Nos. 3,701,529; 3,372,926; 3,826,492; 4,019,734; 4,208,049; and 2,123,233.

SUMMARY OF THE INVENTION

In view of the foregoing, it is the primary feature of the present invention to provide tumbling-type exercise apparatus that provides means for storing and using the energy expended by the user to enable aerial aerobatic-type exercise that is quite similar to that achievable through the use of a trampoline.

It is another feature of this invention to provide a novel aerial exercise assembly that enables a user to accomplish trampoline-type aerobatics in a safe manner without the risk of injury from falls.

It is another feature of this invention to provide a novel exercise system that enables a user to accomplish rebounding while at the same time accomplishing body positioning and body activities including, flipping, either forwardly or backwardly, accomplishing multiple flips during each bounding cycle, bounding while the users body is at various positions including upright, inverted, substantially seated, etc.

It is a further feature of this invention to provide an inherently safe apparatus for aerial aerobatics which encourages complete bodily exercise during the use thereof and which is considered exciting and exhilarating during use.

It is also a feature of this invention to provide a novel aerial exercise apparatus having the capability of being adjustable to compensate for the height and weight of the user to thus enable a wide range of aerial gymnastics exercises to be accomplished regardless of the height or weight of the user.

Briefly, the various concepts and features of the present invention are realized through the provision of an aerial exercise assembly that enables human users to accomplish bounding, swinging and flipping exercise movements as well as achieving a wide variety of positions and movements during use of the aerial exercise assembly. The apparatus incorporates a pair of swing members that are adapted to extend downwardly from a support such as the ceiling of a building structure or from a support framework that is mounted to the floor of a building or to the ground. A pair of elongate elastic members, each having a plurality of elastic strings, are connected to the swing members and provide a connection for support of a pair of support straps that extend downwardly from the lower ends of the elastic members. The apparatus is also provided with foot engaging means such as loops or the straps of a foot plate which provide for stabilized interengagement of the apparatus with the feet of the user. A pair of harness pivot straps are provided which establish connection with the intermediate portions of the support straps, particularly at rigid strap connections. The harness pivot straps are connected for 360° pivotal movement relative to the support straps. A pelvic harness is adapted to fit about the pelvic region of the user's body and to provide support for the user at any number of user positions such as upright, inverted or any position between upright and inverted. The pelvic harness incorporates at least one and preferably a pair of spaced waist bands that are secured about the waist of the user by means of adjustment buckles. The harness pivot straps are secured such as by sewing or by any other suitable form of connection to each of the waist bands. The pelvic harness also incorporates crotch straps that cross between the legs of the user and at least one lower pelvic strap that assists in providing adequate support for the user at a substantially seated position. The harness pivot straps are of sufficient length to enable the user to achieve lateral positioning relative to the support straps to thereby enhance the capability of the user to accomplish a wide range of swinging, pivoting and positional movements through use of the aerial exercise assembly.

To enhance the comfort of the user during use of the apparatus an interior harness cushioning pad may be provided to achieve more even distribution of forces from the various harness straps to the pelvic surfaces of the user. To enhance the safety of the aerial exercise assembly, the elongate elastic members are provided with safety cables that limit extension of the elastic members and thus limit downward movement of the user while exercise activities are in progress.

Other features of the present invention will become obvious upon an understanding of the preferred embodiment that is described hereinbelow.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an isometric illustration of an aerial exercise assembly constructed in accordance with the present invention and shown to be installed within a room to provide for indoor exercise activities.

FIG. 2 is a partial isometric illustration of the aerial exercise assembly of FIG. 1 illustrating use thereof.

FIG. 3 is an elevational view illustrating an elongate elastic element that functions as one of the elastic members of the aerial assembly of FIG. 1.

FIG. 4 is an elevational view of the elongate elastic element of FIG. 3, showing an elongate enclosure for assembly thereabout.

FIG. 5 is an elevational view of an elongate elastic element similar to that of FIGS. 3 and 4 and representing an alternative embodiment of this invention.

FIG. 6 is an elevational view illustrating an elongate elastic strand of the elongate elastic element of FIG. 5 and showing snap connectors enabling replacable assembly thereof with the elongate elastic element.

FIG. 7 is an elevational view similar to that of FIG. 8 but incorporating an elongate elastic strand that is doubled.

FIG. 8 is an elevational view similar to that of FIGS. 6 and 7 and showing disconnected elastic strands that may be connected to change the elastic resistance of the elongate elastic member to accommodate persons of differing body weight.

FIG. 9 is an isometric illustration showing the pelvic harness of FIG. 2 in detail.

FIG. 10 is a plan view illustrating a harness cushion to be utilized in assembly with the pelvic harness of FIG. 9.

FIG. 11 is an isometric illustration showing a footboard assembly for use with the aerial exercise assembly of FIGS. 1 and 2.

Figure 1:
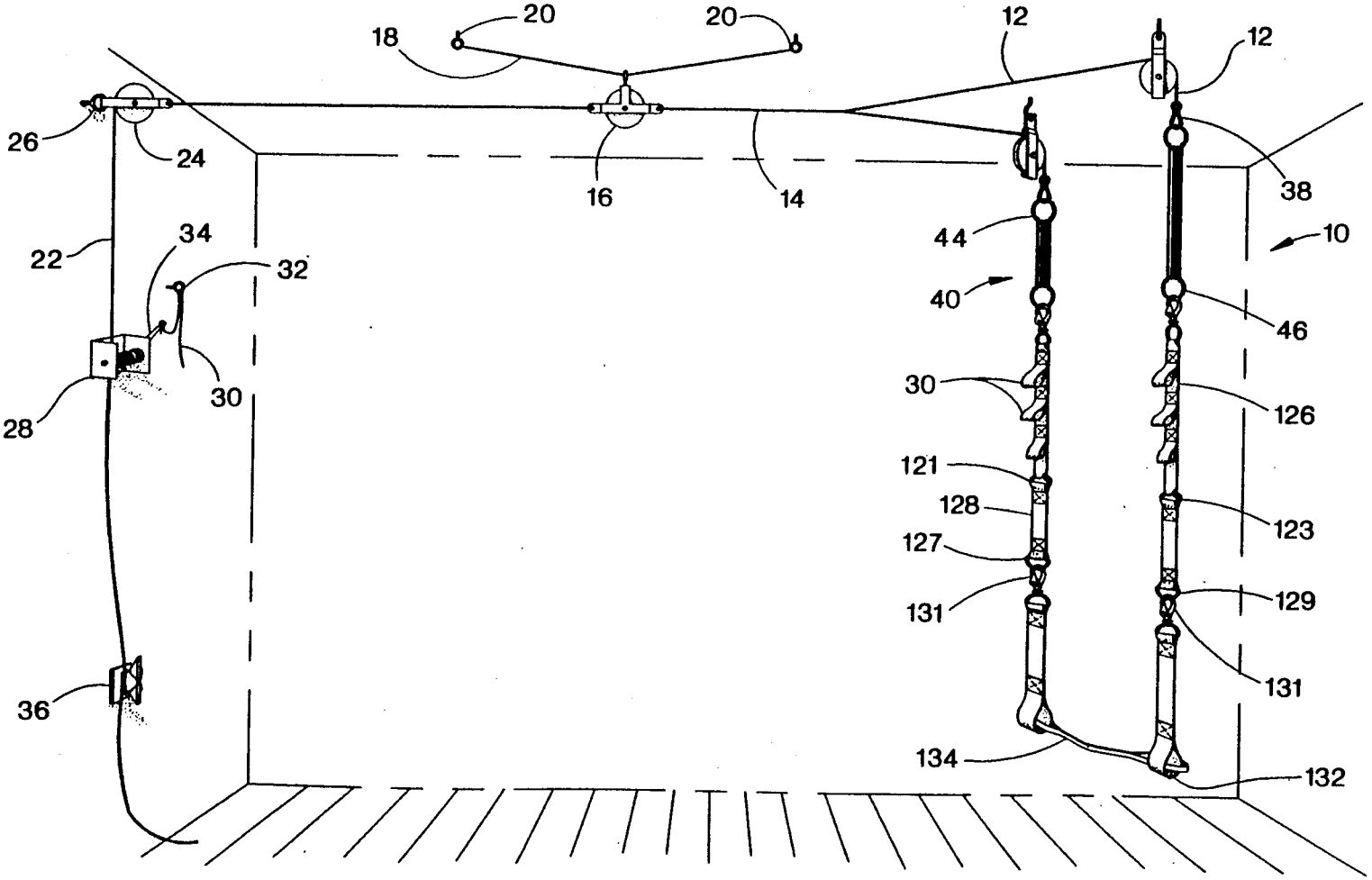
Figure 2:
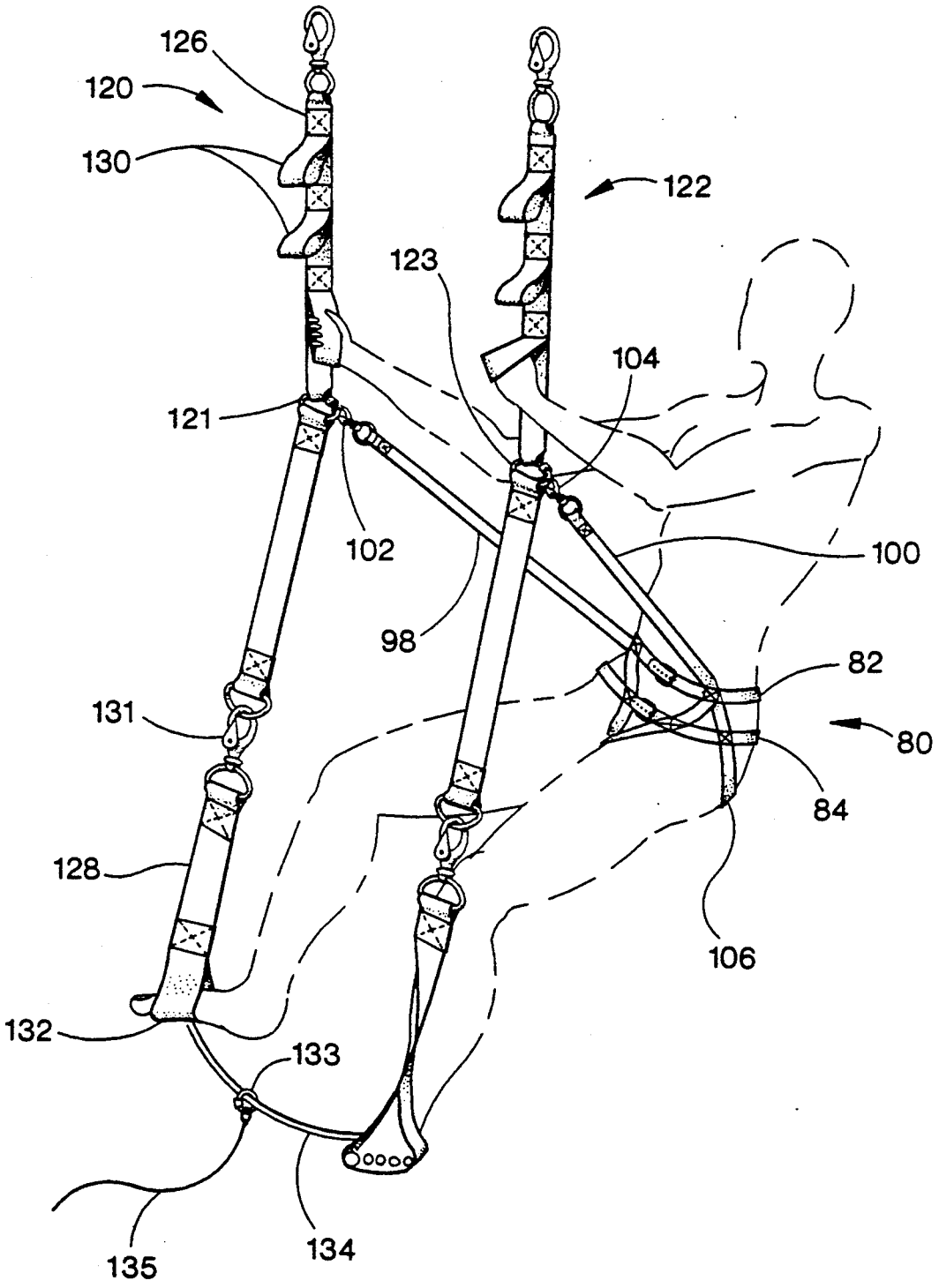
Figure 12:
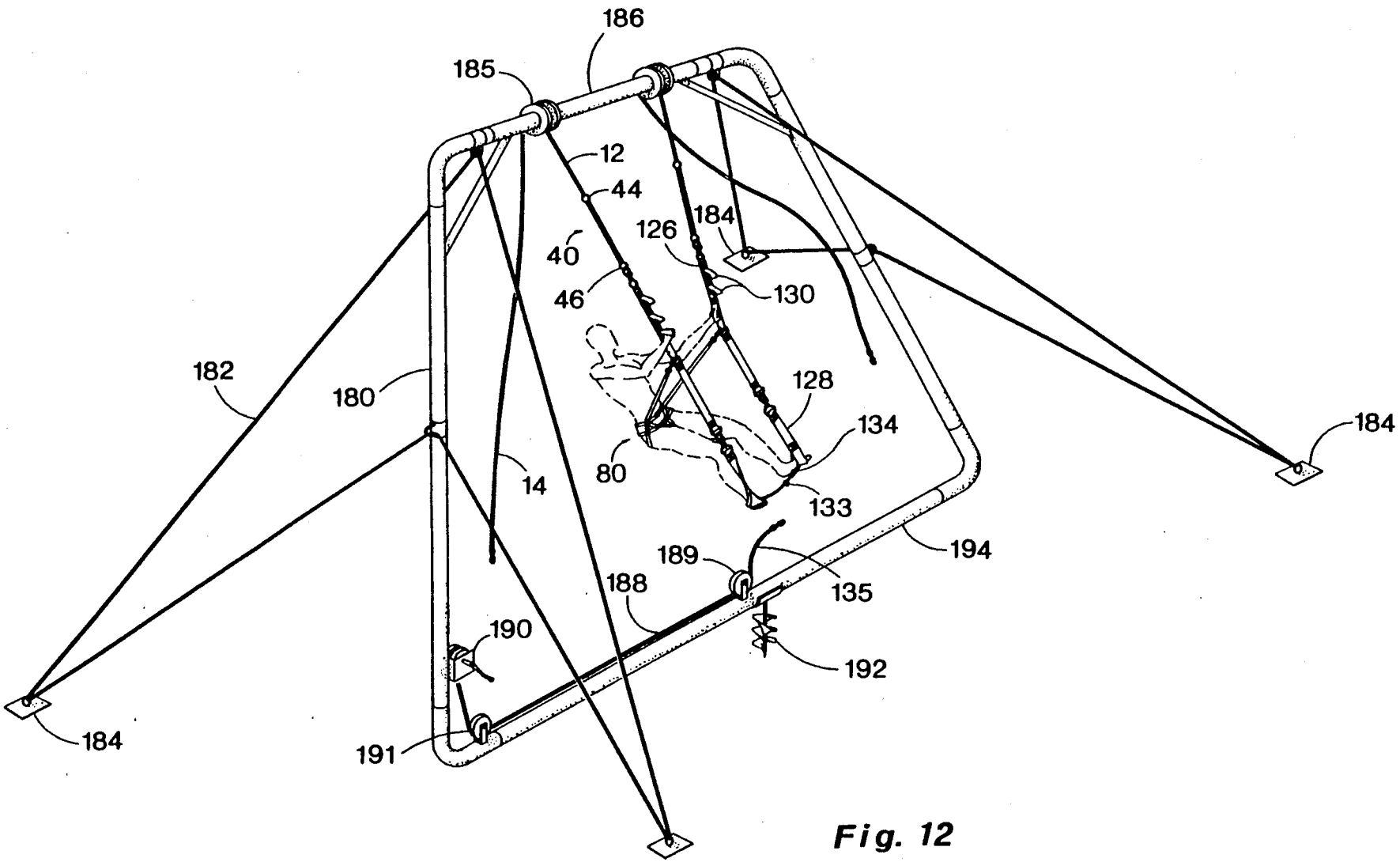

FIG. 12 is an isometric illustration of the aerial exercise assembly of FIGS. 1 and 2, being mounted for outdoor or floor-mounted use and further showing the apparatus is use.

Figure 13:
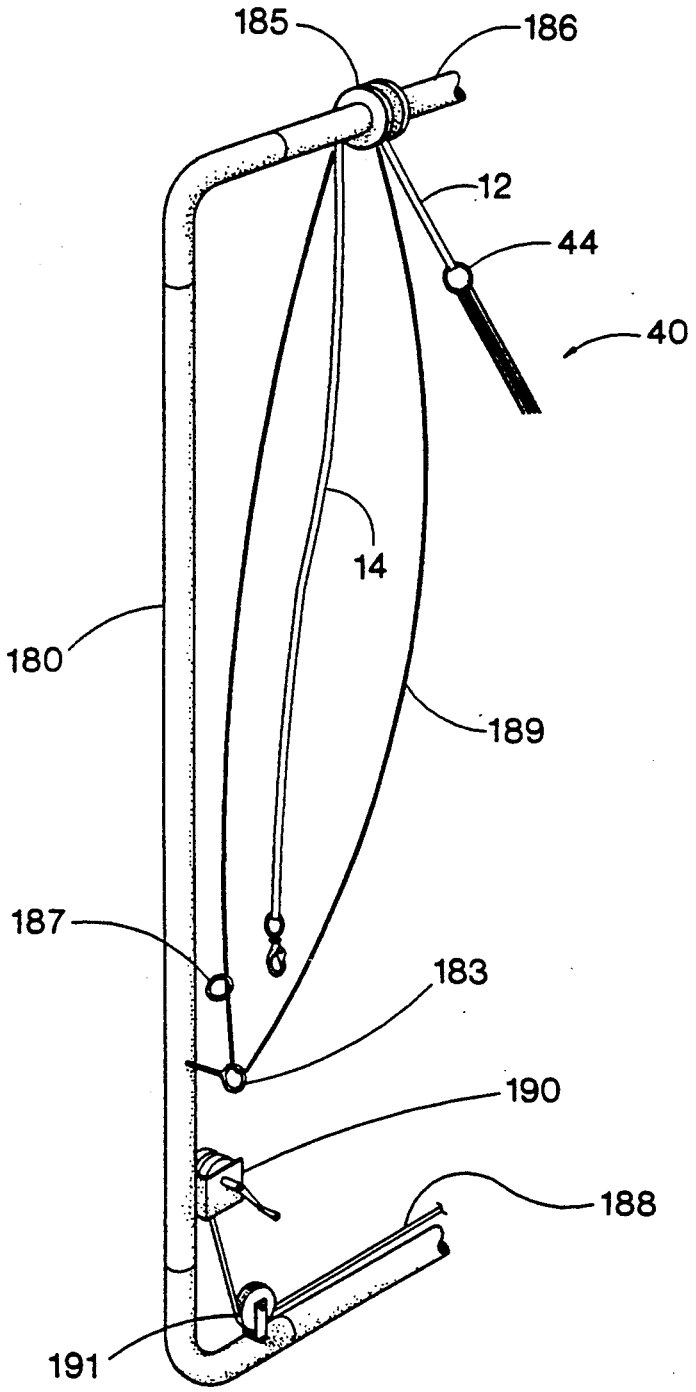

FIG. 13 is a partial isometric illustration of the aerial exercise assembly of FIG. 12, showing the strap hoisting mechanism thereof in detail.

DETAILED DESCRIPTION OF THE PREFERRED EMBODIMENT

Figure 3:
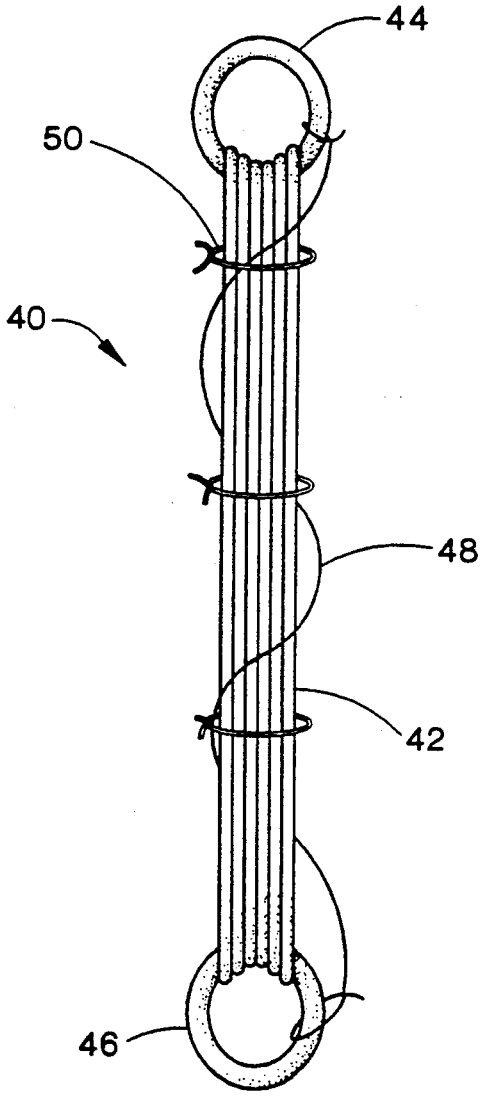
Figure 11:
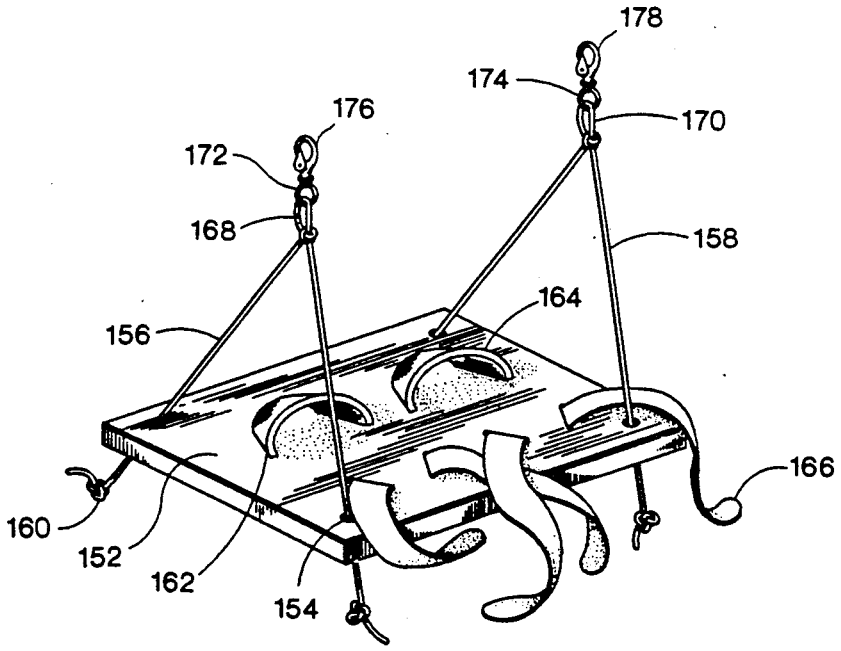

Referring now to the drawings and first to FIGS. 1 and 2, an aerial exercise assembly constructed in accordance with the present invention is shown generally at 10 which may be supported from the ceiling structure of an exercise room as shown in FIG. 1, or which may be supported by a framework that is assembled to the floor structure of a building or to the ground for outdoor use as shown in FIG. 11. The aerial exercise assembly 10 incorporates a pair of elongate swing support elements 12 which may conveniently take the form of high-strength fabric straps or ropes. The swing support elements serve to support the user and to permit the user to accomplish swinging movements perhaps in concert with other aerial movements such as forward or backward flips. Support elements 12 may be connected to any suitable structure for support thereof but, as shown in FIGS. 1 and 3, they may be connected to a single rope or strap 14 that enables the exercise assembly to be elevated to any suitable level above the floor or ground. In the embodiment shown in FIG. 1, the rope 14 is shown to be received by a multi-sheaved pulley 16 which is in turn supported by a short running cable 18 which is connected to the ceiling structure by means of eye bolts 20. For achieving movement of the pulley 16 along the cable 18 and to minimize the force required for hoisting a user to exercise position, a hoisting rope 22 is received by the sheaves of the pulley 16 and extends about a pulley 24 that serves to change the force direction of the hoisting rope from substantially horizontal to substantially vertical. The pulley 24 is supported by an eye bolt 26 that projects from the wall structure of the building to enable the hoisting rope 22 to be secured. A halyard stop 28 or other suitable rope brake device may be secured to the wall structure of the building as shown so as to establish a controllable breaking relationship with the hoisting rope. A release rope 30 for the halyard stop is shown to extend through a wall mounted eye bolt 32, with one of its ends connected to the halyard stop 34. The eye bolt 32 functions to change the direction of pull on the halyard stop so that it may be efficiently controlled by a person standing on the floor of the building. Additionally, an anchor device 36 may be mounted to the wall structure of the building so as to function as a positive anchor to tie off the hoisting rope 22.

Figure 4:
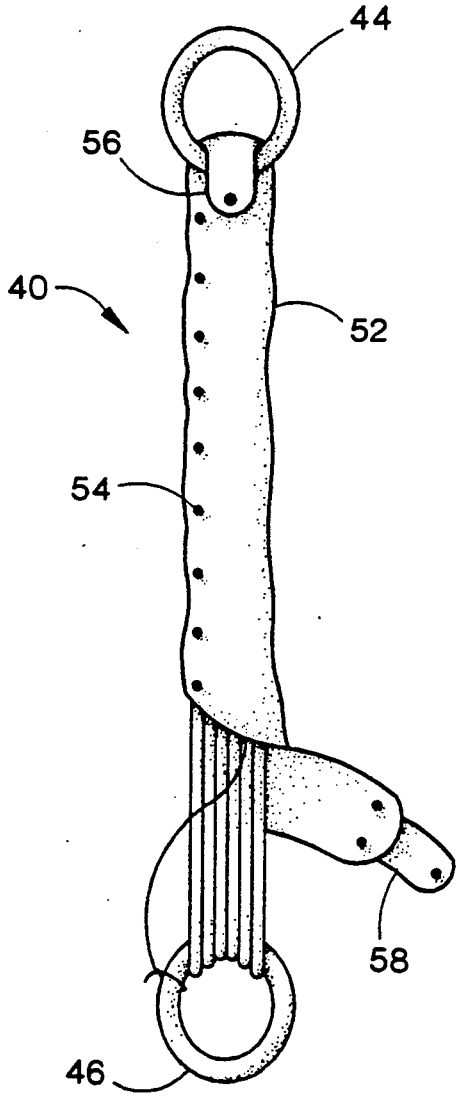

The support straps or ropes 12 are provided with connector means which, in the preferred embodiment, may take the form of quick-links or swivel connectors 38 that enable the releasable coupling thereof to respective elongate elastic elements shown generally at 40 and which are shown in greater detail in FIGS. 3 and 4. The elongate elastic elements will typically comprise a plurality of elongate elastic strands 42 each of which may comprise one or more strands of elastic material. As one suitable example, the elongate elastic strands 42 may conveniently take the form of rubber strips such as strips of surgical tubing The strands 42 may be assembled with the respective extremities secured to connector rings 44 and 46 or to any other suitable connector elements. Some of the elastic strands may have the ends thereof permanently secured to the connector rings 44 and 46 and some of the elastic strands may be releasably secured to the connector rings at one or both of their ends so as to permit ready adjustment of the elastic resistance of the elongate elastic elements. Swivel connectors will allow relative rotation between the swing support elements 12 and the elastic members 40.

Since at times users of the aerial exercise assembly will be descending rapidly with the body oriented in any number of positions that are possible through the use of the assembly, it will be appropriate to limit extension of the elongate elastic elements 40. One suitable means for accomplishing this safety feature may comprise an inelastic elongate flexible member 48 such as a multi-strand wire cable having the respective ends thereof affixed to the connector rings 44 and 46. The safety cable 48 may be spiraled about the various strands 42 of the elastic element 40 as shown. Additionally, to maintain the safety cable 48 in close proximity about the multiple strands 42 of the elastic member, a plurality of cable binders 50 may be secured about the elastic strands and safety cable as shown in FIG. 3. These cable binders may be composed of elastic material such as surgical tubing or may take any other suitable form. As shown in FIG. 4, each of the elongate elastic members 40 may be provided with an extensible protective cover 52 having snaps 54 to secure it in position about the elastic strands and safety cable. The cover 52 may be provided with connector flaps 56 and 58 that are extended through the connector rings 44 and 46 respectively, and secured in place by straps such as shown at the upper portion of FIG. 4 The cover 52 further serves to contain any elastic strands that are not secured to both of the connector rings.

Figure 5:
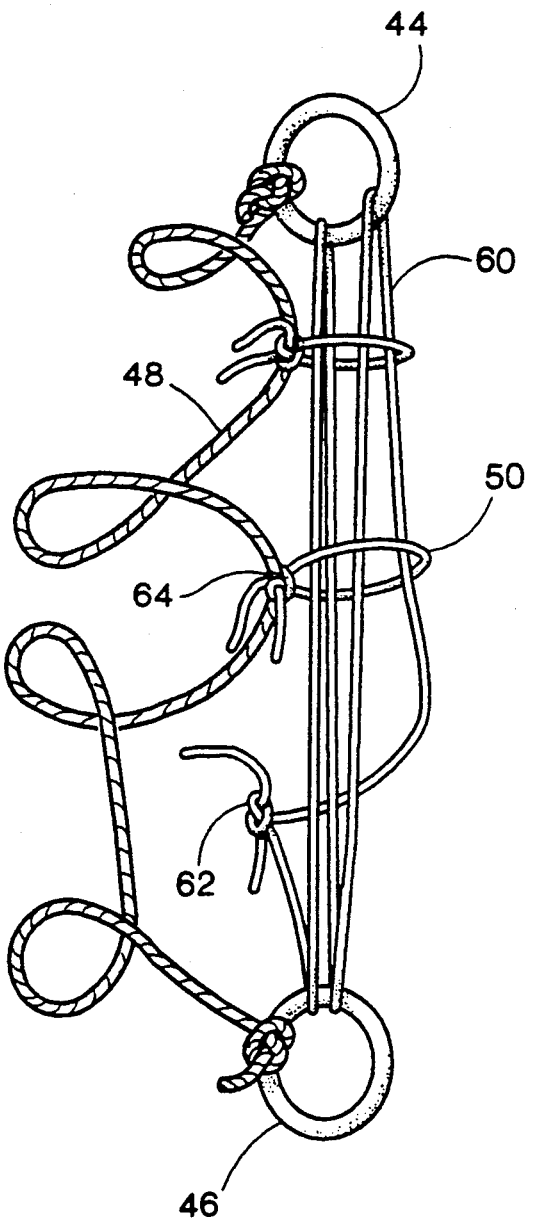

As illustrated in FIG. 5, an alternative embodiment of the elongate elastic member 40 may employ a single strand of elastic material 60 that may be looped a number of times about the connector rings 44 and 46 as shown, with the opposite ends thereof being secured together by a knot 62 or by any other suitable means of connection. In this embodiment, the safety cable 48, which serves the same function as described above in connection with FIG. 3 has its respective ends to the connector rings 40 and 46. Cable binders 50 are secured about the multiple runs of the elastic strand 60 with knots 64 securing them in position and also establishing secured connection with the safety cable 48 at spaced locations along the length thereof. Any suitable number of cable binders may be employed in this fashion.

Figure 6:
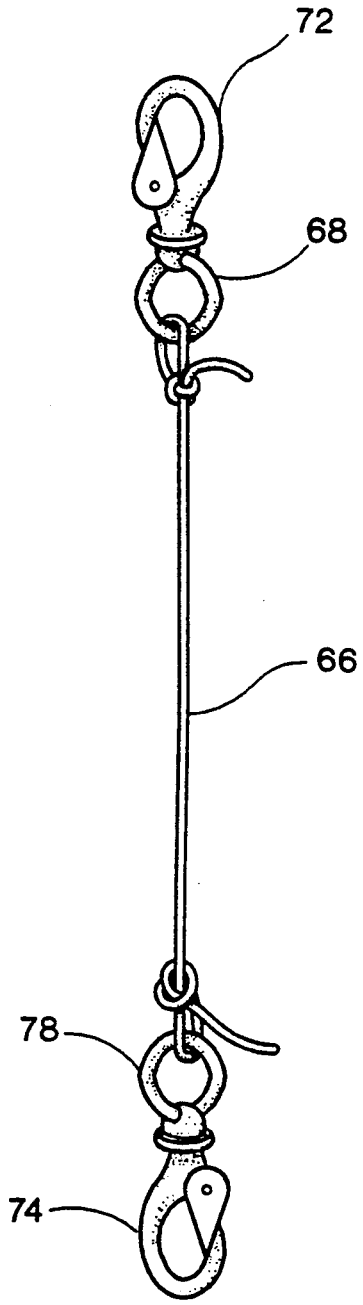
Figure 7:
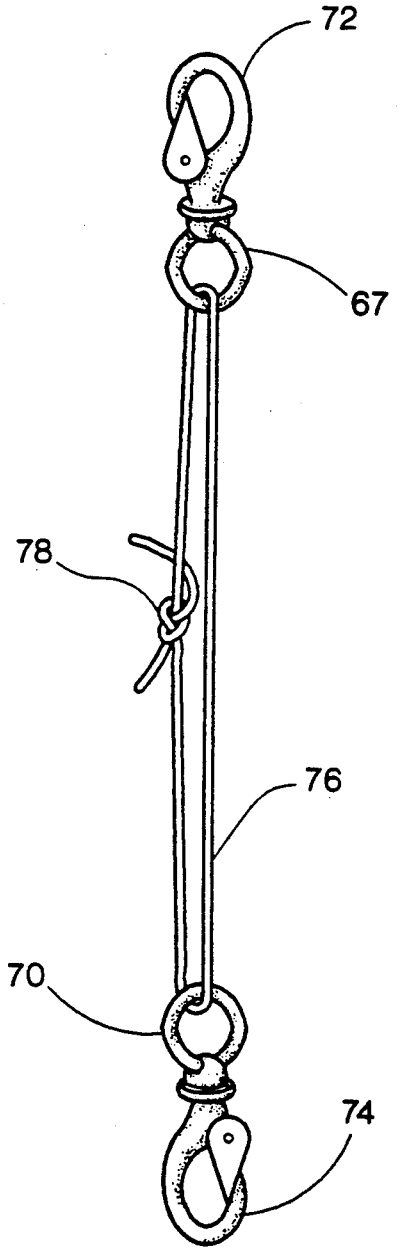

With reference to FIGS. 6 and 7, it should be born in mind that the elongate elastic members 40 may comprise any suitable number of elastic strands 42 for the purpose of adequately supporting the tension forces to which the elastic members will be subjected. These tension forces will depend largely upon the weight of the user and the character of aerial exercises to be performed. Accordingly, it is considered desirable to provide for adjustment of the resistance of the elastic members. This feature is accomplished by providing the capability of including any suitable number of elastic strands depending upon the weight of the user. For example,e ach elastic strand may have the capability of adequately resisting user weight in the order of 25 pounds. Accordingly, if the user has a weight of 100 pounds, the elastic members may have four strands. If the user, on the other hand, has a weight of 200 pounds, then the elastic members may incorporate eight elastic strands. In order to facilitate adjustment of the number of strands incorporated within the elastic member 40, each of the strands or each pair of strands may conveniently take the form shown in FIGS. 6 and 7. In FIG. 6, a single elastic strand 66 is shown with each end thereof secured at the connection eye 68 and 70 of quick disconnect connecting devices 72 and 74. Each of these connecting devices may incorporate swivels that allow the connection eyes to rotate relative to the oonneotor portions. As shown in FIG. 7, a single strand of elastic material 76 is shown which is looped about the connection eyes 68 and 70 of the snap swivel connectors 72 and 74, with the respective ends of the elastic member being secured together as shown at 78. The arrangement shown in FIG. 7 permits the elastic member to have a double run, thus providing double the force resistance as compared to the embodiment of FIG. 6.

Figure 8:
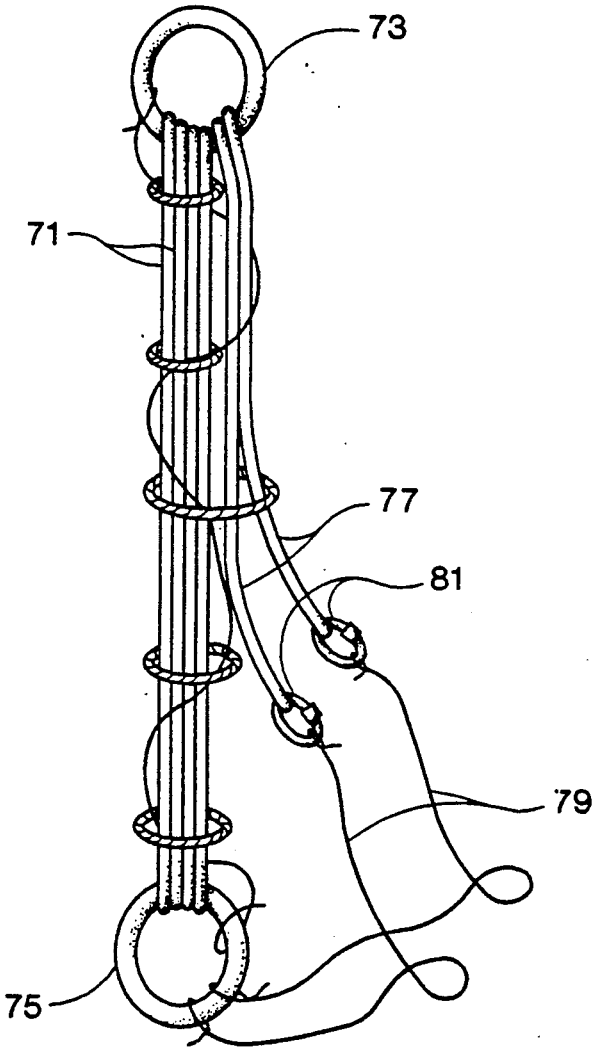

As shown in FIG. 8 certain elastic strands 71, three being shown, are permanently connected to the connecting rings 73 and 75 while other elastic strands 77 have only the upper ends thereof coupled to the ring 73. To increase the elastic tension resistance of the elastic member, one or both of the strands 77 may be coupled to the lower ring 75. Pull cords 79 are coupled to the lower quick connects 81 to enable the elastic strands to be pulled downwardly for connection to the rings thus elongate elastic member need not be unsheathed in order to change its elastic resistance.

Figure 9:
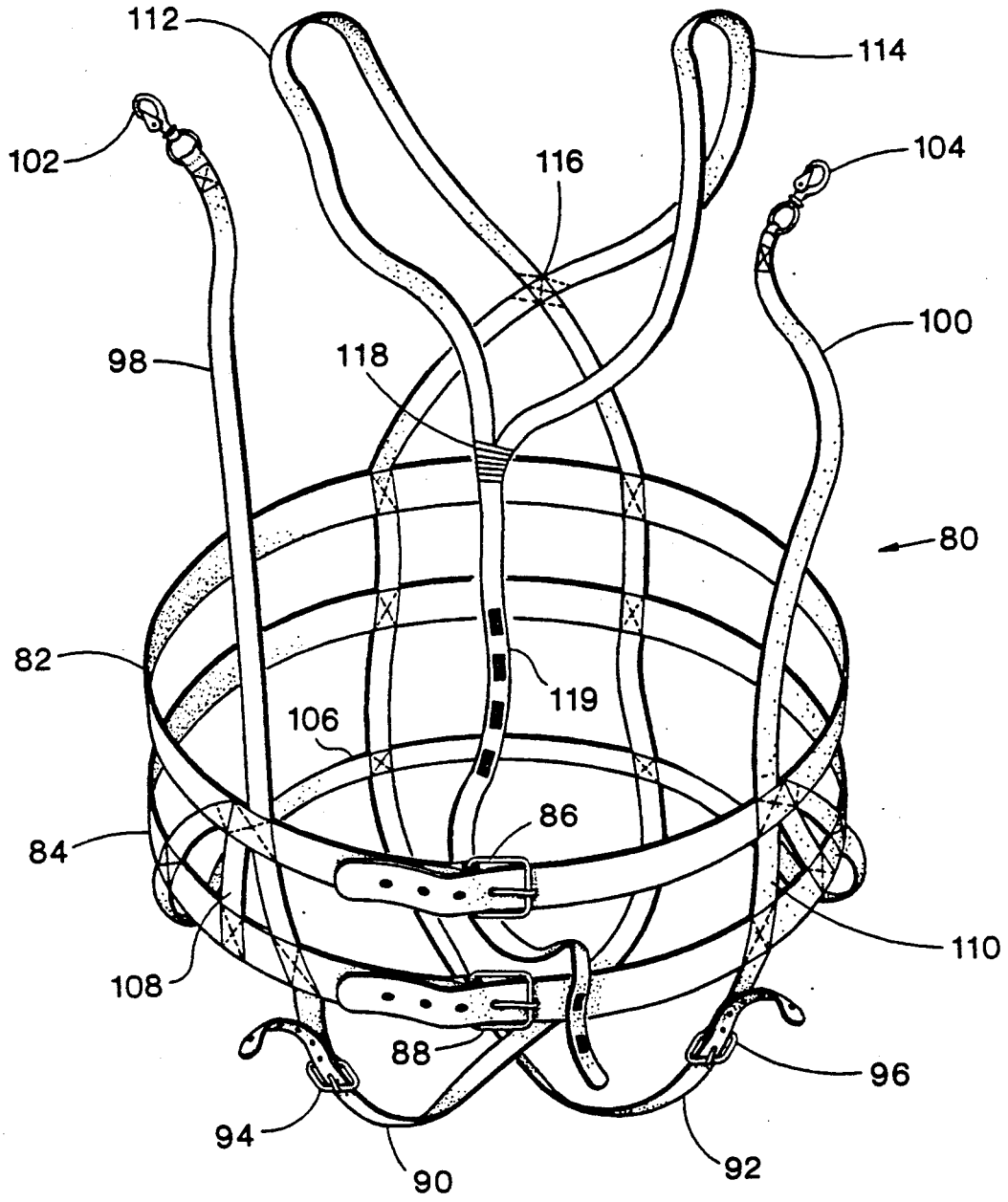

According to the teachings of the present invention, it is desirable to provide a harness for support of the user and to further insure that the harness has the capability of supporting the user whether upright, inverted, substantially seated or at any other position that is capable of being achieved by the user through use of the aerial exercise assembly. Accordingly, one suitable pelvic harness may take the form shown generally at 80 in FIGS. 2 and 9. The pelvic harness will incorporate a waist band adapted to be secured tightly about the waist of the user. As shown in FIG. 9, the waist band of the harness incorporates a pair of vertically spaced waist straps 82 and 84 which are disposed in spaced relation. The waist straps are shown to incorporate hook and eye type buckles 86 and 88 which permit the waist straps to be securely fastened about the waist of the user and which provide for adjustment of the waist band for the waist sizes of different users. It is to be born in mind, however, that adjustment buckles of any suitable character may be employed without departing from the spirit or scope of this invention. The pelvic harness is also provided with a pair of crotch straps 90 and 92 which cross between the legs of the user. The crotch straps are also provided with adjustment buckles 94 and 96 to compensate for anatomical differences of the users. The rear portions of each crotch strap are sewn or otherwise connected to the rear portions of the waist bands 82 and 84 while the front portions of the crotch straps are connected to the front portions of the waist bands as shown in FIG. 9.

Upward extensions of the front portions of the crotch straps define harness pivot straps 98 and 100 having swivel connectors 102 and 104 provided at the upper extremities thereof as shown in FIGS. 2 and 9 which permit rotatable connection of the pelvic harness to each of the support straps in the manner shown in FIG. 2. The harness pivot straps are capable of 360° rotation about its connection with both the harness and support straps to permit a wide range of exercise movements to be accomplished. The swivel connection is capable of rotating vertically about the connection rings and permits the straps 98 and 100 to rotate about their swivel connection with the support rings. The harness pivot straps are connected at the side portions of the front half of the waist band of the harness to enhance the capability of substantially seated positioning as shown in FIG. 2. The pelvic harness is also provided with a rear support strap 106 which, in the substantially seated position as shown in FIG. 2, provides support beneath the buttocks of the user. The rear support strap also extends about the side portions of the harness with the upper ends thereof being sewn or otherwise connected to the side portions of the waist straps 82 and 84 at each side of the front portion of the harness. To further strengthen the connection of the harness pivot straps to the pelvic harness, a pair of vertical straps 108 and 110 are shown to be sewn or otherwise connected to the waist straps 82 and 84, with the upper ends thereof reinforcing the connection of the pivot straps 98 and 100 to the front-side portions of the harness structure Thus, at the point of connection of the pivot straps 98 and 100 to the upper waist strap 82, three force-distributing straps are provided to efficiently transmit forces from the pivot straps to the waist straps, the crotch straps and the rear support strap.

The pelvic harness 80 may also be provided with shoulder straps as shown at 112 and 114 in FIG. 4 which are arranged to extend over the shoulders of the user and which cross at the back of the user and are sewn together as shown at 116. At the front portion of the harness, the shoulder straps 112 and 114 come together and are joined at 118 to a single vertical adjustment strap 119. The strap 119 is adjustably connected to buckle 86 or to any other connector device provided on one or both of the waist straps 82 and 84 of the waist band.

To provide support for the user and to permit a wide range of serial exercise movements the apparatus incorporates a pair of support straps shown generally at 120 and 122 which provide means for receiving the hands and feet of the user. To provide for various efficient positioning of the pelvic harness relative to the support straps and to facilitate selected positioning of the feet, legs and hands of the user in relation to the support straps, quick links 121 and 124 may be interconnected intermediate the extremities of the support straps so as to separate the support straps into upper and lower strap sections such as shown at 126 and 128 in FIGS. 1 and 2. Additionally, the quick link connector rings 121 and 123 permit the lower sections of the support straps to be provided with any suitable lower assembly, such as the foot loop supports of FIGS. 2 and 2 and the foot board assembly of FIG. 11. Selective connection of these components is achieved by snap swivels 131 and or any other suitable connectors. The quick connect elements 121 and 123 also function as connector points for receiving the connectors 102 and 104 of the harness pivot straps 98 and 100. The connectors 122 and 124 further permit the upper and lower sections of the support straps to be disposed in angular relation with one another as shown in FIG. 2 to thereby permit the user to achieve a substantially seated position. The upper strap sections 126 of the support straps are each provided with a plurality of hand loops 130 which are adapted receive the hands and wrists of the user to provide for secure connection of the hands to selected locations along the length of the support straps if desired. the lower strap sections 128 are each provided with foot receiving means such as the strap loops 132 to receive the feet of the user in secured assembly therewith. In the alternative, means for receiving and securing the feet of the user may take any other suitable form, such as a foot board which will be discussed hereinbelow. Means is also provided to restrict spacing of the foot loops 132 to thereby stabilize the legs of the user. In the embodiment shown in FIGS. 1 and 2, a cross strap is provided having opposed ends thereof secured to the foot loops 132. The cross strap 134 is flexible, thereby allowing the feet of the user to be placed in side-by-side location if desired, but limiting spreading of the feet and legs of the user. The cross strap may be provided with a central connector such as shown in the form of a quick link 133 which permits a pull cord 135 or other suitable device to be connected to the cross strap. The pull cord may be used to pull the support straps down such as for mounting by the user and may also be used to swing the user.

The various straps of the swing support member, the support straps and the various harness straps may be conveniently composed of high-strength fabric strap material such as that manufactured and sold by E.I. DuPont under the registered trademark "Nylon". In the alternative, the strap material may be composed of leather of any of a number of other suitable strap materials without departing from the spirit and scope of the present invention. Additionally, any oombination of strap materials may be employed that facilitates efficient and safe manufacture and use of the aerial exercise assembly.

Figure 10:
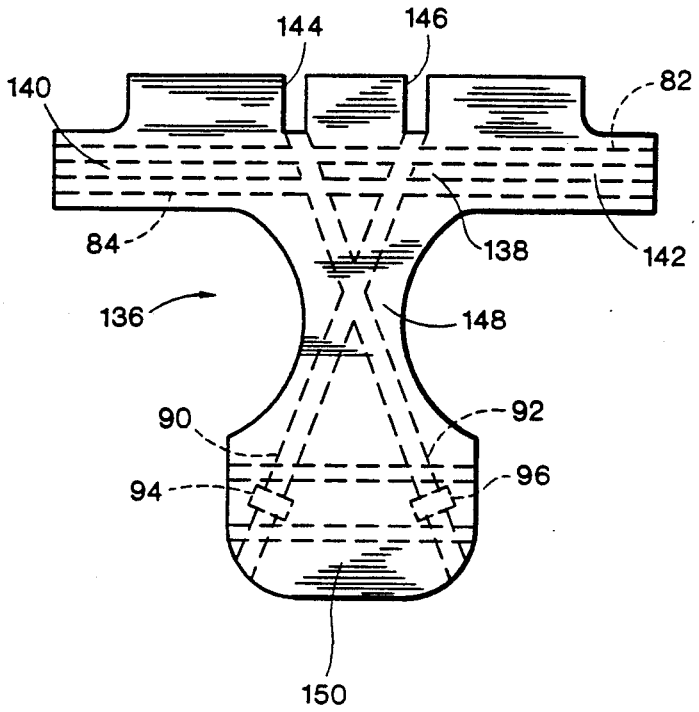

Although the pelvic harness 80 may be efficiently utilized in the form shown in FIG. 10, nevertheless, it may be desirable to provide the harness with interior padding to enhance the comfort of the user. A harness cushioning pad is shown generally at 136 in FIG. 9 with the relationships of the harness straps being indicated thereon by means of broken lines. The harness pad includes a rear portion 138 which extends about the rear portion of the pelvic region of the user, with opposed side sections 140 and 142 that curves about the side portions of the pelvic region of the user. The harness pad is formed to define rear slots 144 and 146 through which the shoulder straps 112 and 14 of the harness extend. The rear and side portions of the harness pad are of sufficient vertical width to receive the entire waistband of the harness, including the upper and lower waist straps 82 and 84. The crotch portion of the harness pad is of sufficient width to receive the crossing crotch straps 90 and 92 as shown. The harness pad is also provided with a front pad section 150 which is intended to curve about the central portion of the abdomen of the user and to extend upwardly a sufficient distance to provide cushioning for the front portion of the harness where the waist straps and buckles are located. The harness pad 136 may be composed of any suitable padded material having sufficient structural integrity that it will not deteriorate significantly during use. A harness pad composed of a heavy fabric backing and with a body-contacting surface composed of fabric pile similar to that of thick floor carpeting has been found to function quite well.

As mentioned above, the means for securing the feet of the user to the aerial exercise assembly may take the form of a foot plate or board. As shown in FIG. 11, a foot board 152 of generally rectangular form is provided having corner holes 154 for receiving a pair of bridles 156 and 158 which may be composed of rope, wire cable, or any other suitable material. The rope or cable may be knotted below the foot board as shown at 160 to secure the bridles to the foot board. In the alternative, any other suitable means for positively securing the bridles to the foot board may be employed within the spirit and scope of this invention. The foot board 152 is formed to define a plurality of slots such as shown at 162 which slots are provided to receive foot straps 164. The terminal ends 166 of the foot straps are adapted to be secured about the ankles of the user and are provided with any suitable means for securing the straps about the ankles. For example, the terminal ends 166 of the foot straps may be provided with a connector material such as that sold under the registered trademark "Velcro" thus enabling the feet of the user to be securely positioned relative to the foot board 152.

The bridle ropes 156 and 158 are provided with a centralized loop such as shown at 168 and 170 which receive quick connect couplings 172 and 174 which secure the bridles to swivel connector elements 176 and 17S. The swivel oonnectors are receivable by connector rings 127 and 129 which may be provided in the lower sections of the support straps and which may be located typically at the height of the knees of the user.

.The upper surface of the foot board 152 may be provided with a non-slip material that will enhance the stability of the user's feet to remain stable during aerial exercise activities.

Although FIG. 1 illustrates positioning of the aerial exercise assembly within a building and being supported by various apparatus secured to the ceiling and walls of the building, such is not intended to be limiting with respeot to the present invention. As shown in FIG. 12, the aerial exercise assembly may be supported by the floor structure of a large building or may be installed on the ground for outdoor exercise activities. In such case, a trapezoidal shaped framework 180, which may be formed of assembled framework segments such as metal or polymer pipe, may be secured in upright position by a plurality of guy wires 182 which are secured to ground or floor anchors 184. As shown in FIGS. 12 and 13 the swing support ropes or straps 12 extend over the upper cross-member 186 of the framework and are received by protective spools 185 that are trotatably mounted by the cross-member. The spools prevent chafing or abrasion of the swing support ropes or straps as they are moved relative to the cross-member. As illustrated in FIG. 13 the free ends 14 of the swing support ropes are adapted for connection to the tractor eyes 187 of continuous hoisting lines 189 that extend over the spools 185 and pass through the eye on an eye bolt 183. the hoisting lines are employed to position the free ends of the hoisting ropes or straps for connection to the eye bolt 183 or to any other anchor support that may be provided therefor.

As shown in FIG. 12 the pull cord 135 may be coupled to the quick link connector 133 for manipulation of the harness and harness supports. A pull rope or cable 188 is connectable to the pull cord and extends through guide pulleys 189 and 191 to a winch 190. With the pull cord connected to the quick link coupling 133 and with the pull rope 188 coupled to the pull cord the winch 190 may be operated to apply a downward force through the cross-strap 134 to the support straps, thus stretching the elastic members 40 and allowing the harness to be lowered and secured at a position where the user can put on or take off the harness. Thereafter, the winch can be reversed to permit the elastic members to contract and reposition the support straps and harness at its operative position for exercising.

For stabilization of the lower portion of the frame work, especially for outdoor activity, an anchor device 192 which is secured to the lower horizontal portion 194 of the framework is adapted to penetrate the earth and to prevent movement of the framework relative to the ground or other structure to which the framework is secured.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. An aerial exercise assembly for human users to enable bounding, swinging and flipping exercise movements, comprising:

(a) a pair of swing members adapted to extend downwardly from a support;

(b) a pair of elongate elastic members being connected to the lower ends of said swing members;

(c) a pair of support straps extending downwardly from the lower ends of said elongate elastic members;

(d) foot engaging means being provided at the lower ends of said support straps for stabilized interengagement with the feet of a user;

(e) a pair of elongate harness pivot elements each being connected intermediate the extremities of a respective one of said support straps for 360° pivotal movement relative to said support straps;

(f) a pelvic harness adapted to fit about the pelvic region of the user's body and providing support for the user whether the user is positioned upright, inverted or at positions between upright and inverted, said pelvic harness being connected to said harness pivot elements and adapted for pivotal movement relative thereto.

2. The aerial exercise assembly of claim 1 wherein:

said harness pivot elements are of sufficient length to permit the pelvic region of the user's body to be located forwardly and rearwardly of said support straps so as to enable a wide variety of user positions and movements during aerial exercise activities.

3. The aerial exercise assembly of claim 2, wherein:

(a) connector elements are located intermediate the extremities of said support straps; and (b) said harness pivot elements comprise elongate harness pivot straps extending from said pelvic harness and incorporate harness couplings for assembly with said connector elements.

4. The aerial exercise assembly of claim 3, wherein:

(a) said connector elements comprise rigid connector rings to which upper and lower sections of said support straps are connected; and (b) said harness couplings comprise swivel connectors being fixed to said elongate harness pivot straps and adapted for coupling with said rigid connector rings.

5. The aerial exercise assembly of claim 1, wherein said elongate elastio members each comprise (a) a plurality of elastic strands having a desired resistance to the force to be encountered during exercise activities;

(b) means for securing respective ends of said elastic strands to said swing members and to said support straps; and (c) means for limiting extension of said elongate elastic members.

6. The aerial exercise assembly of claim 5, wherein said means for limiting extension of said elongate elastic members comprises:

elongate flexible safety cables interconnecting said swing members and said support straps and being of a length to stop downward movement of said support straps at a predetermined maximum extension of said elongate elastic members.

7. The aerial exercise assembly of claim 5, wherein said means for securing respective ends of said elastic strands to said swing straps comprises:

(a) strap connector elements being fixed to opposed ends of said swing members and said support straps; and (b) strand connector elements being secured to respective ends of each of said elastic strands and being receivable by respective ones of said strap connector elements.

8. The aerial exercise assembly of claim 7, wherein:

said strand connector elements are releasably secured to said connector elements, thus enabling a desired number of said elastic strands to comprise said elongate elastic members.

9. The aerial exercise assembly of claim 8, wherein:

each of said elastic strands is comprised of hollow tubing composed of elastomeric material.

10. The aerial exercise assembly of claim 1, wherein:

said swing members, said support straps and said harness pivot straps are composed of high strength fabric material for safe support of the user during use of said aerial exercise assembly.

11. The aerial exercise assembly of claim 1, wherein:

a plurality of hand and arm support loops are provided in spaced relation along the length of said support straps, enabling selective positioning of the hands of the user relative to said support straps.

12. The aerial exercise assembly of claim 1, wherein:

a rigid connector element is coupled intermediate the extremities of each of said support straps, said second ends of said harness pivot straps establishing releasable pivotal connection with respective ones of said rigid connector elements.

13. The aerial exercise assembly of claim 1, wherein said pelvic harness comprises:

(a) at least one waist band having a buckle connection and enabled to be securely fastened about the waist of the user;

(b) a pair of crotch straps having respective ends thereof secured to front and rear sides of said waist bands and enabled to cross in overlapping relation between the legs of the user, said crotch straps each having buckle connections enabling adjustment thereof to properly fit the body of the user; and (c) said harness pivot straps being connected to and extending from said waist band.

14. The aerial exercise assembly of claim 13, wherein:

a single harness strap is connected to said crotch straps at the rear portion of said pelvic harness and is connected a opposed sides thereof to said waist band, each end of said harness strap forming said harness pivot straps.

15. The aerial exercise assembly of claim 14, wherein:

quick release swivel connectors are provided at each end of said harness pivot straps for releasable connection to respective ones of said support straps.

16. The aerial exercise assembly of claim 13, wherein:

(a) said waist band comprises a pair of vertically spaced waist straps each having a connector buckle at the front portion of said pelvic harness; and (b) said crotch straps and said harness pivot straps each being fixed to each of said spaced waist bands.

17. The aerial exercise assembly of claim 13, wherein:

said harness pivot straps establish connection at opposed side portions of said waist band.

18. The aerial exercise assembly of claim 13, wherein:

said harness pivot straps establish connection at opposed side portions of said waist band and on the front half of said waist band.

19. The aerial exercise assembly of claim 1, wherien said foot engaging means comprises:

(a) foot engaging straps forming loops and being provided at respective lower ends of said support straps and being receivable respectively about the feet of the user, thus enabling the user to achieve a standing position relative to said aerial exercise assembly; and (b) means for limiting spreading of the feet of the user.

20. The aerial exercise assembly of claim 19 wherien said means for limiting spreading of the feet of the user comprises:

an elongate member having respective ends thereof connected to said support straps.

21. The aerial exercise assembly of claim 20 wherein:

said elongate member comprises a flexible strap member having loops at the respective ends thereof, said loops being received by said loops of said foot straps.

22. The aerial exercise assembly of claim 19, wherein said means for limiting spreading of the feet of the user comprises:

a foot plate having retaining straps thereon for securing the feet and ankles of the user to said foot board and said foot board further having bridles being connected to said support straps.

23. The aerial exercise assembly of claim 1, wherein said foot engaging means comprises:

(a) a rigid foot plate having a pair of bridles at opposed sides thereof, said bridles establishing connection with said support straps; and (b) foot engaging straps being connected to said foot plate and adapted to receive the feet and ankles of the user in secured relation therewith.

24. The aerial exercise assembly of claim 1, including: an interior cushioning pad being provided within said pelvic harness for cushioned force distribution from said pelvic harness to the pelvic region of the user.

* * * * *